US010519615B2

(12) United States Patent
Miller

(10) Patent No.: US 10,519,615 B2
(45) Date of Patent: Dec. 31, 2019

(54) ACTUATABLE PLOW BLADE GROUND SUPPORT METHOD AND APPARATUS

(71) Applicant: Thomas A. Miller, Waterloo, IN (US)

(72) Inventor: Thomas A. Miller, Waterloo, IN (US)

( * ) Notice: Subject to any disclaimer, the term of this patent is extended or adjusted under 35 U.S.C. 154(b) by 230 days.

(21) Appl. No.: 15/592,465

(22) Filed: May 11, 2017

(65) Prior Publication Data

US 2017/0328021 A1 Nov. 16, 2017

Related U.S. Application Data

(60) Provisional application No. 62/335,820, filed on May 13, 2016.

(51) Int. Cl.

| | |
|---|---|
| ***E01H 5/06*** | (2006.01) |
| ***E02F 3/815*** | (2006.01) |
| ***E02F 3/84*** | (2006.01) |
| ***E02F 9/26*** | (2006.01) |
| *E01H 5/09* | (2006.01) |

(52) U.S. Cl.

CPC ..... *E01H 5/066* (2013.01); *E02F 3/8157* (2013.01); *E02F 3/847* (2013.01); *E02F 9/264* (2013.01); *E01H 5/061* (2013.01); *E01H 5/065* (2013.01); *E01H 5/09* (2013.01)

(58) Field of Classification Search

CPC ..... E01H 5/066; E01H 5/061; E01H 5/065; E01H 5/09; E02F 3/8157; E02F 3/847; E02F 9/264

See application file for complete search history.

(56) References Cited

U.S. PATENT DOCUMENTS

| | | | | | |
|---|---|---|---|---|---|
| 2,061,585 | A | * | 11/1936 | Meyer | E01H 1/105 15/245 |
| 2,094,515 | A | * | 9/1937 | Abbe | E01H 5/063 37/232 |
| 2,511,123 | A | | 6/1950 | Norris | |
| 2,513,231 | A | * | 6/1950 | Bourne | E01H 5/066 172/676 |
| 2,778,126 | A | * | 1/1957 | Shannon | E01H 5/065 29/14 |
| 2,933,838 | A | | 4/1960 | Rockwell | |
| 3,011,276 | A | | 12/1961 | Likely | |
| 3,466,766 | A | * | 9/1969 | Kahlbacher | E01H 5/062 15/245 |
| 3,587,182 | A | * | 6/1971 | Hirt | E01H 5/063 172/794 |
| 3,793,752 | A | | 2/1974 | Snyder | |

(Continued)

*Primary Examiner* — Jamie L McGowan

(74) *Attorney, Agent, or Firm* — Taylor IP, P.C.

(57) ABSTRACT

A ground support apparatus for a material moving implement configured for moving a material from a surface. The material moving implement has a front surface and a rear surface. The ground support apparatus includes an actuating system that has at least one skid shoe actuator attached to the rear surface of the material moving implement, and at least one skid shoe operably coupled to the at least one skid shoe actuator. The skid shoe includes a first end configured for coupling to the at least one skid shoe actuator and a second end configured for contacting the surface. The ground support apparatus also includes manually-operated skid shoe controls operably connected to the actuating system and operable to actuate the at least one skid shoe actuator.

20 Claims, 5 Drawing Sheets

(56) References Cited

U.S. PATENT DOCUMENTS

| | | | | | |
|---|---|---|---|---|---|
| 4,259,794 | A * | 4/1981 | Rath | E01H 5/062 | 37/232 |
| 4,570,366 | A * | 2/1986 | Yost | E01H 5/061 | 172/701.1 |
| 5,628,371 | A * | 5/1997 | Behrens | A01B 73/00 | 172/395 |
| 5,720,122 | A | 2/1998 | McLellan | | |
| 6,003,455 | A * | 12/1999 | Flamme | A01C 23/007 | 111/200 |
| 6,434,462 | B1 * | 8/2002 | Bevly | A01B 69/008 | 172/3 |
| 6,711,837 | B2 * | 3/2004 | Bloxdorf | E01H 5/06 | 37/231 |
| 7,354,067 | B2 * | 4/2008 | Majkrzak | B60S 9/20 | 280/6.154 |
| 8,449,217 | B2 * | 5/2013 | DiPizio | E02F 5/12 | 404/83 |
| 8,732,988 | B2 | 5/2014 | Hanson | | |
| 9,080,297 | B2 | 7/2015 | Hanson | | |
| 9,598,829 | B2 * | 3/2017 | Betts | E01H 5/098 | |
| 2014/0277954 | A1 * | 9/2014 | Nelson, Jr. | A01C 21/00 | 701/50 |
| 2015/0240453 | A1 * | 8/2015 | Jaliwala | E02F 9/2041 | 701/50 |
| 2016/0044868 | A1 * | 2/2016 | Bassett | A01D 57/20 | 56/376 |
| 2017/0328021 | A1 * | 11/2017 | Miller | E01H 5/066 | |

* cited by examiner

ACTUATABLE PLOW BLADE GROUND SUPPORT METHOD AND APPARATUS

CROSS REFERENCE TO RELATED APPLICATIONS

This is a non-provisional application based upon U.S. provisional patent application Ser. No. 62/335,820, entitled "ACTUATABLE PLOW BLADE GROUND SUPPORT METHOD AND APPARATUS", filed May 13, 2016, which is incorporated herein by reference.

BACKGROUND OF THE INVENTION

1. Field of the Invention

The present invention relates to vehicles having a material moving implement, and, more particularly, to a ground support apparatus to support the material moving implement.

2. Description of the Related Art

Snow plows are well-known mechanical devices that are used to remove unwanted snow from various surfaces. The blades of the snow plows are mounted on many different vehicle types such as commercial trucks, pick-up trucks, SUV's, tractors, and other apparatuses. The snow plow blades can be found in several configurations such as V-blades, straight blades, curved blades, etc. depending upon the needs of a user.

It is also well-known in the art to optionally mount support devices on the bottom of the snow plow blade. Such devices are called skid shoes, shoe skids, blade feet, skis, wheels, etc. The snow plow blade skid shoes are incorporated to protect the surface that is being plowed and/or the edge of the blade which makes contact with the surface.

Skid shoes are typically modular and replaced as they are worn. They can also be manually adjusted to provide a desired height between the surface being plowed and the bottom edge of the blade. For example, it may be desirable to have different blade heights when plowing snow over various surfaces such as concrete, dirt, asphalt, gravel or stones. The operator must be aware of the surface being plowed and adjust the height accordingly.

A problem with current snow plow blade supports is that they need to be manually adjusted depending upon the desired height between the blade and surface to be plowed. Typically, the operator must exit the vehicle and manually adjust the snow plow blade supports by using tools or other ways of adjusting the supports. If an operator is plowing several different surfaces, there is a frequent need to readjust the height of the blade supports. The frequent adjusting, readjusting of the blade supports can be incommodious and cumbersome, especially in inclement weather. Also, the adjustment of the blade supports can be inefficient in that the operator loses time that could be spent plowing.

Another problem with current snow plow blade supports is that the operator may not know what type of surface is being plowed. For example, the operator may have no previous knowledge of the type of surface being plowed as a result of not having seen the pre-plowed surface. There are also instances where the operator is tasked with plowing several different areas and has forgotten the type of surface for each. Catastrophic results such as the blade catching on the surface, with accompanying damage to the blade and vehicle, can occur.

What is needed in the art is a cost-effective and efficient apparatus to adjust the height of the blade supports.

SUMMARY OF THE INVENTION

The present invention provides a manual or automatic actuatable height adjustment of snow plow blade supports such as skid shoes. The actuation can be through hydraulic, pneumatic, electric, or other systems.

The present invention provides a ground support apparatus for a material moving implement configured for moving a material from a surface. The material moving implement has a front surface and a rear surface. The ground support apparatus includes an actuating system that has at least one skid shoe actuator attached to the rear surface of the material moving implement, and at least one skid shoe operably coupled to the at least one skid shoe actuator. The skid shoe includes a first end configured for coupling to the at least one skid shoe actuator and a second end configured for contacting the surface. The ground support apparatus also includes manually-operated skid shoe controls operably connected to the actuating system and operable to actuate the at least one skid shoe actuator.

The present invention also provides a vehicle configured for moving a material. The vehicle includes a material moving implement connected to the vehicle and configured for moving the material from a surface. The material moving implement has a front surface and a rear surface. The vehicle also includes a ground support apparatus. The ground support apparatus includes an actuating system that has at least one skid shoe actuator attached to the rear surface of the material moving implement, and at least one skid shoe operably coupled to the at least one skid shoe actuator. The skid shoe includes a first end configured for coupling to the at least one skid shoe actuator and a second end configured for contacting the surface. The ground support apparatus also includes manually-operated skid shoe controls operably connected to the actuating system and operable to actuate the at least one skid shoe actuator.

The present invention further provides a method of adjusting a ground support apparatus for a material moving implement configured for moving a material from a surface. The material moving implement has a front surface and a rear surface. The method includes the step of providing the ground support apparatus. The ground support apparatus includes an actuating system that has at least one skid shoe actuator attached to the rear surface of the material moving implement, and at least one skid shoe operably coupled to the at least one skid shoe actuator. The at least one skid shoe includes a first end configured for coupling to the at least one skid shoe actuator and a second end configured for contacting the surface. The ground support apparatus further includes manually-operated skid shoe controls operably connected to the actuating system and operable to actuate the at least one skid shoe actuator. The ground support apparatus also includes at least one GPS receiver configured to sense a location, and a CPU/display unit located on the vehicle and operably coupled to the at least one GPS receiver and the actuating system. The method includes the further steps of arriving at a desired location and one of manually adjusting a height of the at least one skid shoe by an operator manipulating the manually-operated skid shoe controls to actuate the at least one skid shoe actuator to raise or lower the at least one skid shoe, and automatically adjusting a height of the at least one skid shoe by the CPU/display unit actuating the at least one skid shoe actuator to raise or lower the at least one skid shoe according to a type of the surface associated with the location sensed by the at least one GPS receiver.

An advantage of the present invention is that the snow plow blade supports can be raised or lowered for different plowing surfaces by the operator while he is inside the vehicle, thereby saving time and money while obviating the need to face inclement weather.

Another advantage of the present invention is that the height of the snow plow blade supports can be adjusted automatically depending upon the location of the plowing vehicle by way of GPS. A snow plow operator therefore can work in various locations and not need to be personally aware of the type of surface being plowed.

Still another advantage of the present invention is an optimized cost savings realized by increased plowing time, less wear on the snow plow blade edge, and less damage to the surface being plowed.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DESCRIPTION OF THE INVENTION

Throughout the specification, the inventive plow blade ground supports are generically referred to as "skid shoes"; however, using the term "skid shoes" does not impose any limitations on the invention.

Figure 1:
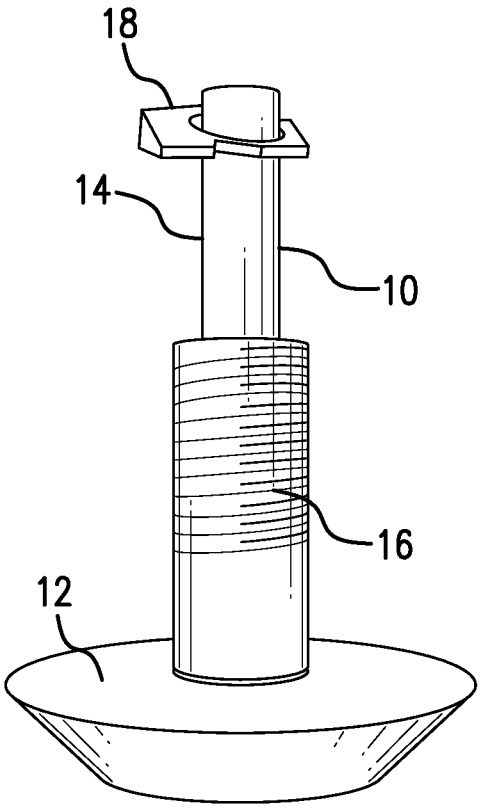
FIG. 1 (Prior Art)
FIG. 1 is an illustration of a prior art skid shoe.

Referring now to the drawings, and more particularly to FIG. 1, there is shown a commercially available skid shoe 10 for a material moving implement, such as a plow. Skid shoe 10 includes a ground contact member 12, a stem 14, adaptors 16 in the form of washers, and an attachment device 18. The skid shoe 10 may be moveably attached to a material moving implement such that the skid shoe 10 can slide up or down relative to the material moving implement. The material moving implement may have a mount near its base with a receiving hole to allow the stem 14 of the skid shoe 10 to pass therethrough. The vertical height of the skid shoe 10 relative to the ground surface may be dictated by the number of adaptors 16 that are positioned in between the contact member 12 and the mount of the material moving implement. Generally, to adjust the height of the skid shoe 10, an operator will exit the vehicle, remove the attachment device 18, uncouple the skid shoe 10 from the mount, add or subtract adaptors 16, and then reattach the skid shoe 10 to the material moving implement.

Figure 2:
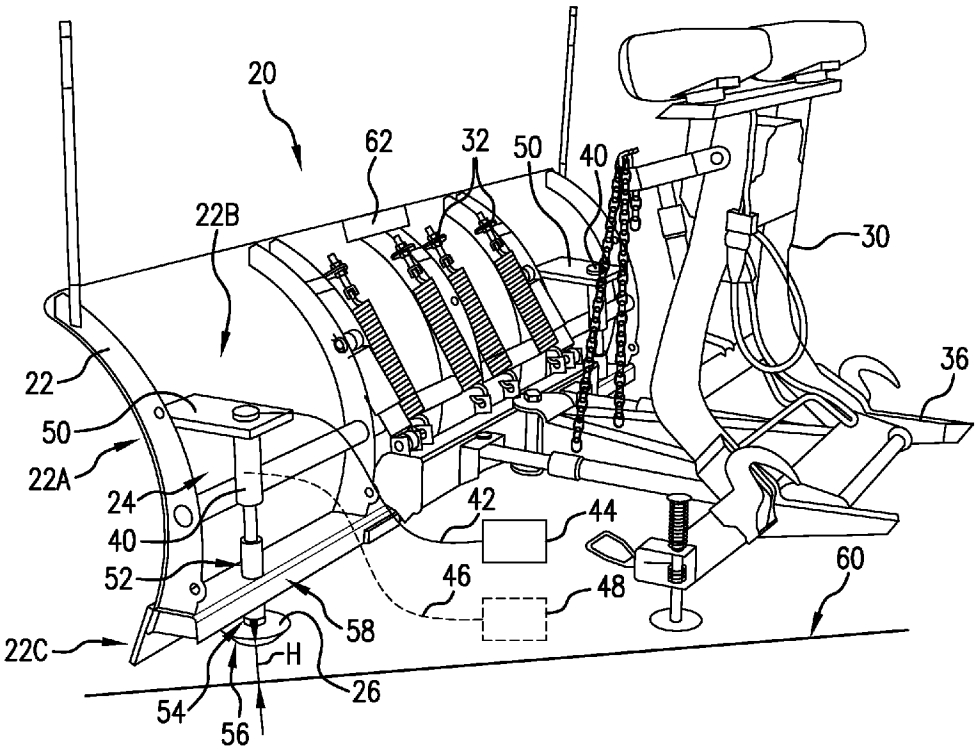
FIG. 2 is an illustration of an embodiment of the ground support apparatus of the present invention.
Figure 3:
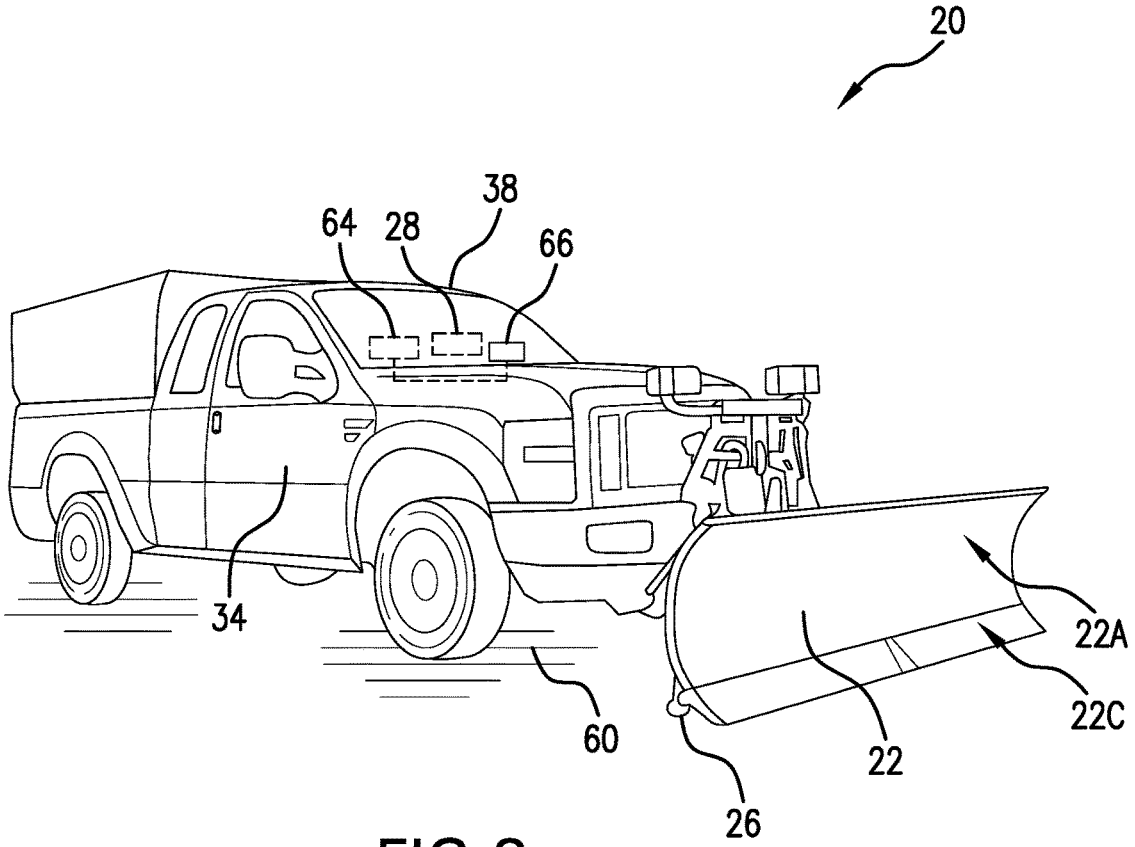
FIG. 3 is an illustration of another embodiment of the ground support apparatus of the present invention.
Figure 4:
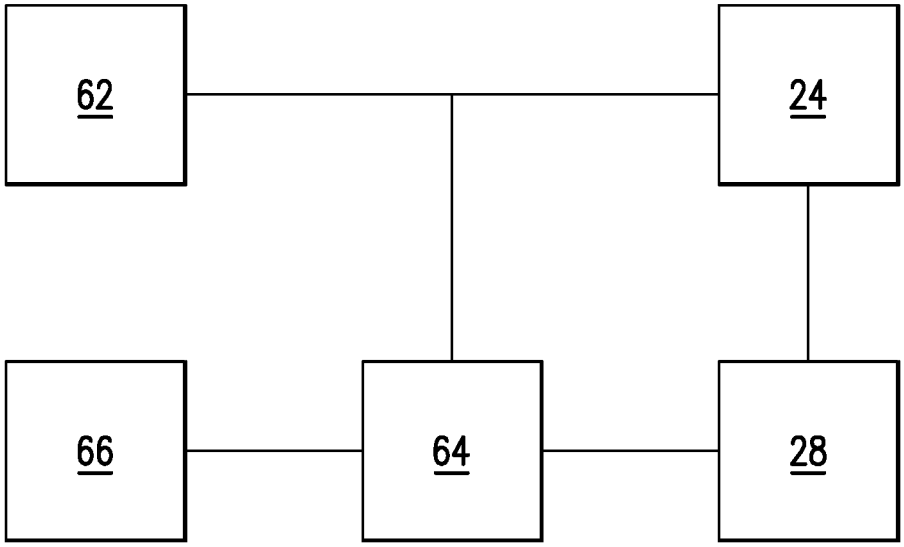
FIG. 4 is a schematic diagram of the ground support apparatus according to the present invention.

Now referring to FIGS. 2-4, there is shown a ground support apparatus 20, which may also be referred to as an actuatable skid shoe apparatus. The ground support apparatus 20 may be coupled to a material moving implement 22 that is configured for moving material from a surface 60. The material moving implement 22 includes has a front surface 22A, a rear surface 22B, and a lower edge 22C that may contact the surface 60. The ground support apparatus 20 generally includes an actuating system 24, at least one skid shoe 26 operably coupled to the actuating system 24, and manually-operated skid shoe controls 28.

The material moving implement 22 may be in the form of a plowing implement 22. The plowing implement 22 can be any known device for removing unwanted material such as a blade, bucket, snow blower, etc. The plowing implement 22 may be attached to a linkage assembly 30 at various locations 32. In turn, linkage assembly 30 may be attached to a vehicle 34 at various locations 36. Vehicle 34 may include a cab 38 and can be any self-propelled apparatus including commercial trucks, pick-up trucks, SUV's, tractors, etc.

The actuating system 24 of the ground support apparatus 20 includes at least one skid shoe actuator 40 attached to the rear surface 22B of the material moving implement 22. The actuating system 24 may include two or more actuators 40. For example, there may be two actuators 40 that are disposed adjacent to the lateral ends of the material moving implement 22. In the present embodiment, the actuating system 24 is in the form of a hydraulic actuating system 24. The hydraulic actuating system 24 includes hydraulic hoses 42 and hydraulic connectors 44. For brevity of description, not shown are valves, pumps, motors, and other components needed for the hydraulic circuit. Alternatively, the actuating system 24 may be an electrical actuating system. In this alternative embodiment shown in phantom, there is included wiring harnesses 46 and electrical connectors 48. Not shown are other electrical components needed for the electrical circuit. Another alternative is a pneumatic actuating system which actuates the ground support apparatus 20.

The at least one skid shoe actuator 40 may be directly attached to the material moving implement 22 or it may be attached to a mount 50 that is in turn fixed to the material moving implement 22. The at least one skid shoe actuator 40 may be mounted substantially vertical onto the material moving implement 22 near the middle to lower portion of the rear surface 22B of the material moving implement 22. However, it is conceivable to mount the actuator(s) 40 at any desired angle and location on the material moving implement 22, such as the top, middle, or bottom portion of the rear surface 22B of the material moving implement 22. The at least one skid shoe actuator 40 may be in the form of a hydraulic, electric, or pneumatic actuator. In the present embodiment, there are two hydraulic actuators 40 in the form of hydraulic cylinders that actuate a respective skid shoe 26.

The at least one skid shoe 26 is operably coupled to the actuator 40 of the actuating system 24 in order to adjust the height H of the skid shoe 26. The one or more skid shoes 26 include a top end 52 that couples to the actuator(s) 40, a middle stem 54, and a bottom end 56 that contacts the ground surface 60. The top end 52 of the skid shoe(s) 26 may directly couple to the actuator(s) 40 by known fasteners, such as pins, screws, and/or bolts, or the top end 52 may interface with an intermediary mount that interconnects the top end 52 and actuator(s) 40. For example, the top end 52 of the skid shoe(s) 26 may be directly coupled to the actuator(s) 40 by a pin extending through corresponding holes in each respective top end 52 and actuator 40. In the present embodiment, there are two skid shoes 26 that connect to respective actuators 40; however, there may be one or more than two skid shoes 26 and actuators 40 displaced along the length of the material moving implement 22. Also, it is conceivable to include two or more skid shoes 26 per actuator 40.

The actuatable skid shoe(s) 26 and/or skid shoe actuator(s) 40 may be attached directly to the plowing implement 20 by any conventional method. The skid shoe(s) 26 may be mounted to the material moving implement 22 as shown or the skid shoe(s) 26 may be only affixed to the actuator(s) 40 such that they are free from contacting the material moving implement 22. As shown, the stem 54 is slideably mounted to the material moving implement 22 by a mount 58 with a receiving hole. The mount 58 is affixed to the lower portion of the rear surface 22B of the material moving implement 22. In this regard, the skid shoe(s) 26 may be allowed to slide up and down relative to the material moving implement 22 as desired.

The manually-operated skid shoe controls 28 may be included within the cab 38 of the vehicle 34. The manually-operated skid shoe controls 28 may be in the form of a touch screen display, buttons, knobs, etc. The operator may actuate the manually-operated skid shoe controls 28 in order to raise or lower the skid shoe(s) 26. To manually adjust the height H of actuatable skid shoe(s) 26 at a desired location prior to or during the plowing of surface 60, the operator of vehicle 34 determines whether or not the current height H of the actuatable skid shoe(s) 26 is adequate and then may operate the manually-operated skid shoe controls 28 accordingly. In turn, through hydraulic or electrical circuits, skid shoe actuator(s) 40 are actuated to either raise or lower actuatable skid shoe(s) 26. Multiple actuatable skid shoes 26 can be raised and/or lowered together or separately.

In an alternative embodiment, the ground support apparatus 20 further includes a Global Positioning System (GPS) receiver 62 and a CPU/display unit 64. The GPS receiver 62 may be attached to the plowing implement 22 or the linkage assembly 30 (FIG. 2). Alternatively or in addition, a GPS receiver 66 may also be located on vehicle 34, for example inside cab 38 (FIG. 3). The GPS receivers 62, 66 may thereby collect location data, i.e. receive signals indicating the current location, of the material moving implement 22 and/or the vehicle 34. It should be appreciated that the GPS receivers 62, 66 may be in the form of any desired location sensor.

The CPU/display unit 64 may display the current height of the actuatable skid shoes 26, notify the operator of the type of surface 60 which is to be plowed, and/or notify the operator to raise or lower the skid shoes 26. The CPU/display unit 64 may be located on the vehicle 34, for example within the cab 38 of the vehicle 34. The CPU 64 may be in the form of a processor such that it can receive signals from the GPS sensors 62, 66 and automatically control the shoe skid actuator(s) 40 of the actuating system 24 to move the shoe skids 22 in a desired position. The CPU 64 may communicate wirelessly or it may be electrically coupled to the GPS receivers 62, 66 and the actuating system 24. The CPU/display unit 64 can be pre-programmed, programmable by the operator, or capable of receiving/downloading programs and data. At least a portion of the data pre-programmed, programmable by the operator, or received/downloaded in addition to the location of vehicle 34 is the type of surface 60 that is to be plowed and/or the desired height of the actuatable skid shoes 26. For example, when the vehicle 34 arrives in a parking lot to be plowed, the GPS data is processed with the surface data to indicate whether the parking lot is concrete, dirt, blacktop, gravel or stones. Actuatable skid shoes 26 can then be manually or automatically adjusted accordingly.

Figure 5:
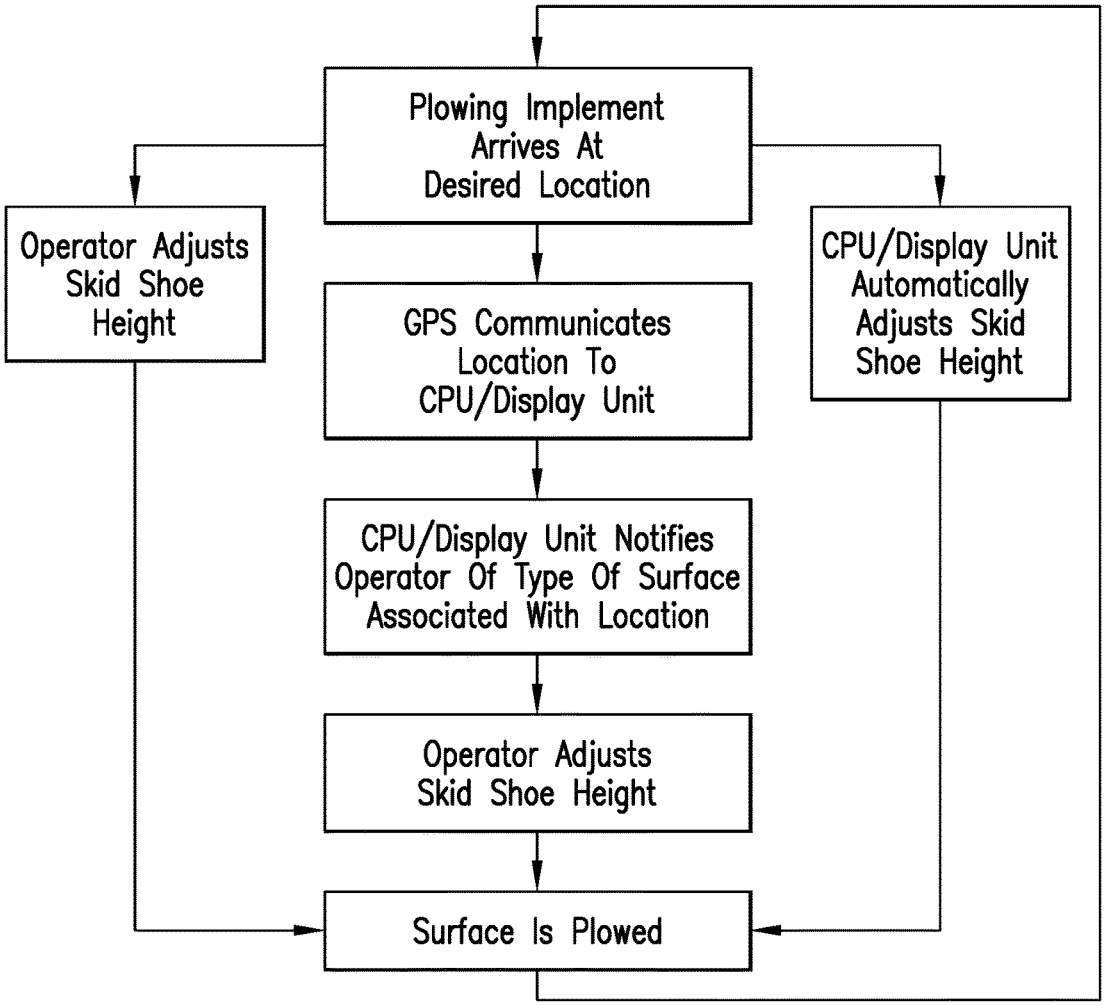
FIG. 5 is a schematic diagram of a method of adjusting the ground support apparatus according to the present invention.

Methods of adjusting the height H of the actuatable skid shoe(s) 26 are schematically illustrated in FIG. 5. When the vehicle 34 and plowing implement 22 arrive at a desired location, one or both of the GPS receivers 62, 66 communicate the location to the CPU/display unit 64. The location data is received/processed by the CPU/display unit 64, and the CPU/display unit 64 notifies the operator of the type of surface 60 associated with the location. Additionally, the CPU/display unit 64 may notify the operator to raise or lower the skid shoes 26. Depending upon a particular surface 60, which is to be plowed, the operator of vehicle 34 determines whether or not the current height of the actuatable skid shoes 26 is adequate. If not, the operator adjusts the skid shoe height H, and thereby the manually-operated skid shoe controls 28 are operated. In turn, through hydraulic or electrical circuits, skid shoe actuators 40 are actuated to either raise or lower actuatable skid shoes 26. Multiple actuatable skid shoes 26 can be raised and/or lowered together or separately. Then, the surface 60 may be plowed, and the vehicle 34 may be moved to a new location. Alternatively, CPU/display unit 64 may automatically adjust the skid shoe height H. In other words, the GPS data and the associated surface data may be used to automatically actuate skid shoe actuators 40 to raise or lower actuatable skid shoes 26 as required. Another alternative is for the operator to use manually-operated skid shoe controls 28 to actuate skid shoe actuators 40 to raise or lower actuatable skid shoes 26 as required. For example, a snow plow traveling along and plowing a concrete road and having a desired height H of actuatable skid shoes 26 may turn on to a dirt road, whereby either by the operator's actions or automatically the skid shoe actuators 40 are actuated to either raise or lower actuatable skid shoes 26 as appropriate for the different surface characteristics.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A ground support apparatus for a material moving implement configured for moving a material from a surface, the material moving implement has a front surface and a rear surface, said ground support apparatus comprising:

an actuating system including at least one skid shoe actuator fixedly attached to the rear surface of the material moving implement;

at least one skid shoe, including:

a first end directly coupled to said at least one skid shoe actuator;

a middle stem which is slideably attached and non-rotatable relative to the rear surface of the material moving implement; and a second end fixedly attached to the middle stem and configured for contacting the surface; and manually-operated skid shoe controls operably connected to the actuating system and operable to actuate the at least one skid shoe actuator, wherein the at least one skid shoe is vertically slideable and non-rotatable, by the at least one skid shoe actuator, relative to the material moving implement.

2. The ground support apparatus of claim 1, further comprising a first GPS receiver located on said material moving implement and configured to sense a location of the material moving implement.

3. The ground support apparatus of claim 2, further comprising a CPU/display unit operably coupled to said first GPS receiver and said actuating system.

4. The ground support apparatus of claim 3, wherein said CPU/display unit is configured to notify an operator of a type of the surface associated with said location of the material moving implement.

5. The ground support apparatus of claim 3, wherein said CPU/display unit is configured to automatically raise or lower the at least one skid shoe according to a type of the surface being plowed.

6. The ground support apparatus of claim 1, wherein an operator manually adjusts a height of the at least one skid shoe by operating said manually-operated skid shoe controls.

7. The ground support apparatus of claim 1, wherein said actuating system includes two skid shoe actuators attached to the rear surface of the material moving implement.

8. The ground support apparatus of claim 7, wherein said at least one skid shoe includes two skid shoes operably connected to said two skid shoe actuators.

9. The ground support apparatus of claim 1, wherein said actuating system is in the form of a hydraulic actuating system and said at least one skid shoe actuator is in the form of a hydraulic cylinder.

10. A vehicle configured for moving a material, comprising:

a material moving implement connected to the vehicle and configured for moving the material from a surface, the material moving implement has a front surface and a rear surface; and a ground support apparatus, including:

an actuating system including at least one skid shoe actuator fixedly attached to the rear surface of the material moving implement;

at least one skid shoe, including:

a first end directly coupled to said at least one skid shoe actuator;

a middle stem slideably attached and non-rotatable relative to the rear surface of the material moving implement; and a second end fixedly attached to the middle stem and configured for contacting the surface; and manually-operated skid shoe controls operably connected to the actuating system and operable to actuate the at least one skid shoe actuator, wherein the at least one skid shoe is vertically slideable and non-rotatable, by the at least one skid shoe actuator, relative to the material moving implement.

11. The vehicle of claim 10, further comprising a CPU/display unit located on the vehicle and operably coupled to said actuating system.

12. The vehicle of claim 11, wherein said CPU/display unit is configured to notify an operator of a type of the surface being plowed.

13. The vehicle of claim 11, further comprising a first GPS receiver operably coupled to the CPU/display unit and located on the material moving implement and configured to sense a location of the material moving implement.

14. The vehicle of claim 11, further comprising a second GPS receiver operably coupled to the CPU/display unit and located on the vehicle and configured to sense a location of the vehicle.

15. The vehicle of claim 11, wherein said CPU/display unit is configured to automatically raise or lower the at least one skid shoe according to a type of the surface being plowed.

16. A method of adjusting a ground support apparatus for a material moving implement configured for moving a material from a surface, the material moving implement has a front surface and a rear surface, said method comprising the steps of:

providing the ground support apparatus, including an actuating system including at least one skid shoe actuator fixedly attached to the rear surface of the material moving implement, at least one skid shoe including a first end directly coupled to said at least one skid shoe actuator and a second end configured for contacting the surface, a middle stem which is slideably attached and non-rotatable relative to the rear surface of the material moving implement, the second end is fixedly attached to the middle stem, manually-operated skid shoe controls operably connected to the actuating system and operable to actuate the at least one skid shoe actuator, at least one GPS receiver configured to sense a location, and a CPU/display unit located on the vehicle and operably coupled to said at least one GPS receiver and said actuating system, the at least one skid shoe is vertically slideable and non-rotatable, by the at least one skid shoe actuator, relative to the material moving implement;

arriving at a desired location; and one of:

manually adjusting a height of said at least one skid shoe by an operator manipulating the manually-operated skid shoe controls to actuate the at least one skid shoe actuator to raise or lower the at least one skid shoe; and automatically adjusting a height of said at least one skid shoe by said CPU/display unit actuating the at least one skid shoe actuator to raise or lower the at least one skid shoe according to a type of the surface associated with said location sensed by said at least one GPS receiver.

17. The method of claim 16, further including an additional step immediately following said step of arriving at said desired location and prior to said step of manually adjusting the height of said at least one skid shoe, said additional step including:

communicating said location by said at least one GPS receiver to said CPU/display unit.

18. The method of claim 17, further including a step immediately following said additional step of communicating said location and prior to said step of manually adjusting the height of said at least one skid shoe, said step including:

notifying the operator of a type of the surface associated with said location sensed by said at least one GPS receiver.

19. The method of claim 16, wherein said at least one GPS receiver of the ground support apparatus includes a first GPS receiver and a second GPS receiver, said first GPS receiver operably coupled to the CPU/display unit and located on the material moving implement and configured to sense a location of the material moving implement, and said second GPS receiver operably coupled to the CPU/display unit and located on the vehicle and configured to sense a location of the vehicle.

20. The method of claim 16, further including a step of plowing said surface.

* * * * *